United States Patent [19]

Clarke

[11] 4,029,316

[45] * June 14, 1977

[54] GAME BALL

[76] Inventor: William Arthur Clarke, 1001 Linden Ave., Erie, Pa. 16505

[ * ] Notice: The portion of the term of this patent subsequent to Mar. 2, 1993, has been disclaimed.

[22] Filed: Feb. 19, 1976

[21] Appl. No.: 659,372

[52] U.S. Cl. ..... 273/58 K; 273/106 R; 273/106.5 A; 46/DIG. 1; 46/17

[51] Int. Cl.[2] ..... A63B 65/00

[58] Field of Search ..... 273/61 A, 106 R, 58 D, 273/58 R, 95 R, 102 R, 106 B, 58 K, 58 A, 58 B, 58 BA, 58 C, 58 F, 58 E, 58 G; 40/327; 46/DIG. 1

[56] References Cited

UNITED STATES PATENTS

| | | | |
|---|---|---|---|
| 442,618 | 12/1890 | Greene | 273/58 D |
| 2,699,901 | 1/1955 | Concepcion | 273/58 D X |
| 3,032,345 | 5/1962 | Lemelson | 46/DIG. 1 X |
| 3,889,950 | 6/1975 | Kasravi | 273/58 D |
| 3,941,383 | 3/1976 | Clarke | 46/DIG. 1 X |
| 3,953,030 | 4/1976 | Muchnick | 46/DIG. 1 X |

*Primary Examiner*—George J. Marlo
*Attorney, Agent, or Firm*—Ralph Hammar

[57] ABSTRACT

Burr coated balls which stick to targets of burr adherent material are made from two rims which intersect in planes at right angles to each other. The rims have flat tread surfaces. The burr coating is applied by tapes having a substantially non stretchable backing and a face of burr material. The backing is adhered to the surfaces with the face outermost. The flat tread surfaces provide better adherence at the edges of the tape. The balls are adapted to injection molding, blow molding and vacuum forming from impact resistant thermoplastics. In one game the players throw the balls against a target of burr adherent material. In another game the players catch the balls with gloves of burr adherent material.

18 Claims, 21 Drawing Figures

GAME BALL

This invention is a burr coated ball in which the burr material is applied to substantially flat cylindrical tread surfaces. One use of the ball is in the game of Application Ser. No. 528,675, now U.S. Pat. No. 3,941,383, and Ser. No. 570,509, incorporated by reference.

In the drawing

FIG. 1 is a top plan view of a hand covering or mitt worn on the catching hand of each player, FIG. 2 is a bottom plan, FIG. 3 is a section of line 3—3 of FIG. 1, FIG. 4 is an elevation of one of the balls used in the game, FIG. 5 is a plan view of one of the parts on the FIG. 4 ball, FIG. 6 is an edge view of the FIG. 5 part, FIG. 7 is a section of line 7—7 in FIG. 5, FIG. 8 is a diagram of the modes of adherence of the ball to the mitt or hand covering, FIGS. 9,10,11,12 are elevations, partly in section of modifications adapted to blow molding and vacuum forming as well as injection molding;

Figure 1:
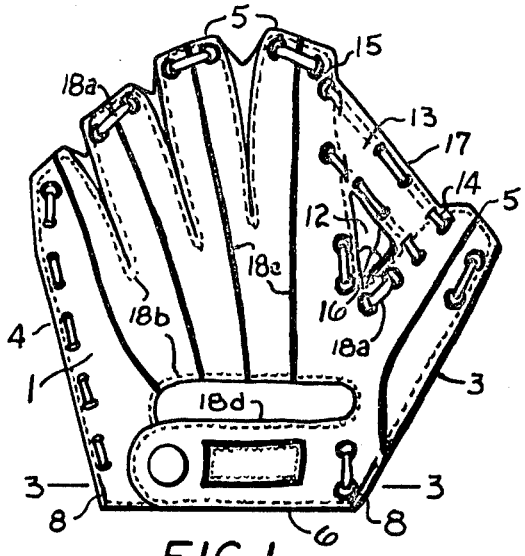
Figure 2:
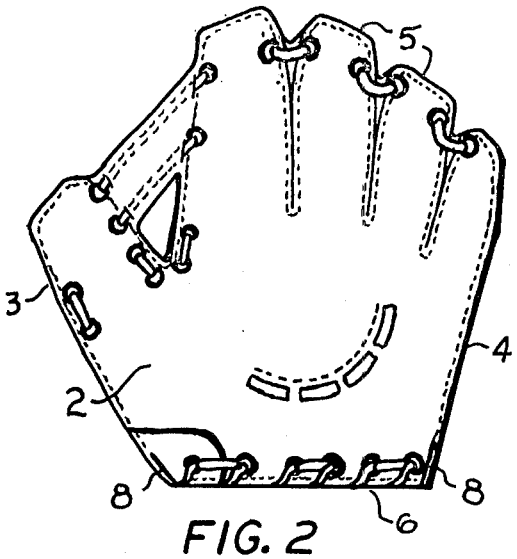
Figure 3:
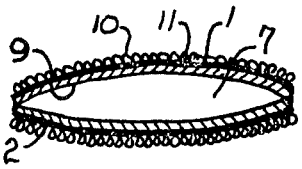
Figure 4:
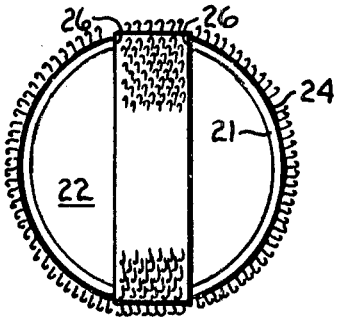

FIGS. 1–8 show a ball and glove for a game of catch in which the players catch a burr coated ball with a glove of burr adherent material. The sheathlike covering which is worn upon the catching hand of each player resembles a baseball glove or mitt. It comprises two substantially identical symetrical pieces 1, 2 of textile material cut out in the shape of a baseball glove or mitt. The pieces are placed back to back and peripherally sealed or sewn along the thumb and little finger sides 3,4 and finger tips 5 leaving at the wrist end 6 a wrist opening 7. Stitching is preferred but other adhesives or means may be used. If adhesives are used the seal may be reinforced by stitching 8 adjacent the wrist. The material for the mitt comprises a flexible textile backing 9, a face or pile 10 of material to which a burr material will adhere upon contact and an intermediate layer 11 of flexible plastic foam sandwiched between and bonded or otherwise fixed to the layers 9 and 10. The burr adhering properties of the face 10 are derived from a multiplicity of loops and fibers which tangle with the hook shaped configurations of burr material. The textile material 9,10,11 is a commerically available material. The outer face 10 has a suedelike appearance and feel. The pieces 1, 2 have a cutout opening 12 providing a web 13 connecting the thumb and forefinger sections 14, 15 of the mitt. A peripheral seam 16 secures the edges of the material around openings. A continuation of the seam 5 joins the edges 17 of the web 13.

The parts so far described structurally define the mitt. When placed on the catching hand, the wearer's thumb is received in the section 14 bounded by the seams 3,5 and 16 and the four fingers are received in a pocket bounded by the seams 4,5 and 16. The feel is similar to a first baseman's mitt. Although individual sheath sections could be provided for each of the wearer's fingers, that is not necessary.

On the back of the mitt, the side visible in FIG. 1, lacing 18*a*, stitching 18*b*, seams 18*c* and a strap 18*d* are printed to give the appearance of a leather mitt. On the palm side of the mitt the side visible in FIG. 2, similar stitching and lacing are printed to give the appearance of the palm side of the leather mitt. The ballpocket is also printed at the back of the palm. The mitt looks like a baseball mitt.

The mitt is adapted to low cost manufacture. The front and back pieces 1,2 are of identical shape, although carrying different printing. The peripheral fastening of the two sheets is easily automated and can be done by high speed operation. In addition to stitching, adhesives, heat sealing and other textile joining processes may be used. Because of the symmetry of the parts 1,2 the left hand glove shown in FIGS. 1 and 2 may be worn on the right hand of a lefthanded player. The glove is always worn on the catching hand of the player leaving the other hand free for throwing.

The game is played with each player wearing on his catching hand a covering such as a glove or mitt with the exterior surfaces of a material to which the burr material adheres upon contact. The burr adherent face should be at least on the palm side of the mitt because that is the side which will usually be presented to the ball. However, for the player who manages to bring any outer surface of mitt into contact with the ball it is desirable that the entire front and back surfaces of the mitt be of burr adherent material.

The players use the ball having its exterior surface coated with burr material. With this combination while playing catch, a player can literally catch any ball his mitt touches. No matter what part of the mitt contacts the ball the ball sticks and is caught. Young children who are just starting to play ctch, are encouraged by the ease of catching and quickly develop skills and coordination which will later be useful in baseball.

A preferred ball for this game is disclosed in my application Ser. No. 528,675, incorporated by reference, Filed Dec. 2, 1974. This ball is adapted to low cost mass production, has long life and a high degree of reliability.

Figure 5:
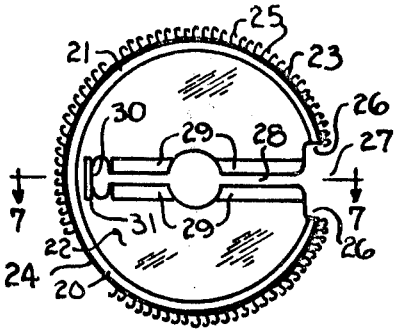

The ball comprises two identical wheel elements 20, each with a cylindrical rim or felly 21 supported by a web or disc 22. On the outer surface of the rim is fixed by adhesives or other suitable means a tread 23 of synthetic burr material such as a tape sold under the trademark "VELCRO". There is a large body of patent literature describing synthetic burr material. This tape is characterized by a backing 24 which is fixed to the outer surface of the rim 21 and a face or pile of hookline spines 25 which simulate the properties of natural burr material. The tape is easily applied to the outer surface of the rim by automatic machinery which rolls onto the rim 21 tape with the backing 24 precoated with pressure sensitive adhesive. The rim 21 is interrupted (FIG. 5) providing circumferentially spaced ends 26 which are spaced apart a distance of slightly in excess of the axial width of the rim. Extending diametrically across the web or disc 22 in a plane 27 extending through the axis of the rim 21 midway between the ends 26 of the rim is a slot 28 having a width substantially equal to the thickness of the disc 22. On opposite sides of the slot are guideways 29 at an angle of substantially 45 degrees to the plane 27. The slot 28 is open at the ends 26 of the rim and has its other end 30 closed by a catch or detent element 31 having detent shoulders 32. When another part identical with that shown in FIG. 5 is rotated 180° and turned into a plane at right angles to the plane 27 with the open ends of the slots 28 aligned and facing each other, pushing the parts together causes the catch 31, of each part to be snapped beneath the ends 26 of the other part. This results in a ball structure having external cylindrical surfaces of burr material which has the flight characteristics of a truly spherical ball.

Figure 8:
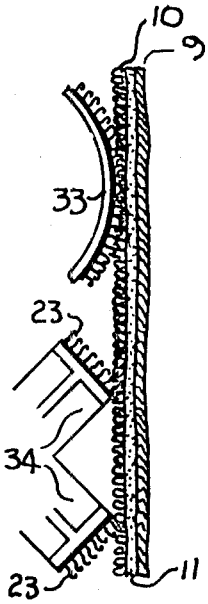

When either tread 23 contacts the outer surface of the mitt, squarely, the adhesion is as illustrated at 33 in FIG. 8. When the treads contact the target in planes at an angle of 45° to the surface of the mitt as shown at 34 in FIG. 8, the edge adhesion is ample and would be ample if only a single edge of the tread made contact with the burr adherent material of the mitt.

The balls of parent applications Ser. Nos. 528,675 and 570,509 each have flat cylindrical surfaces or treads to which a tape of synthetic burr material such as manufactured under the trademark "Velcro" is easily applied. The flat surfaces provide much better adherence than would be obtained if the same tape were applied to a spherical surface. The tape is substantially non stretchable and an attempt to apply the tape to a spherical surface results in lower adhesion at the edges of the tape and causes premature release of the tape at the edges, interfering with the aerodynamic and functional properties of the ball. Once started, the tape peels off. This does not happen with the flat treads because there are no points of low adhesion at the edges of the tape. The treads need not be completely flat, some crowning can be tolerated but the treads cannot have the curvature of spherical surfaces. Another feature of the balls of application Ser. Nos. 528,675 and 570,509 is that the tapes of burr material are easily applied by automated machinery. The treads which have less than 360° extent have well defined edges at which a machine can start to apply the tape. The tread which has 360° extent, can be started at any point in the circumference.

Figure 15:
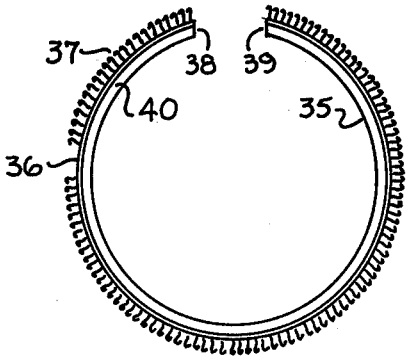
FIG. 15 is a top plan view of another modification.

The foregoing is illustrated in FIG. 15 which shows one of the tread members 35 of application Ser. No. 570,509 having applied thereto a tape of Velcro consisting of a non-stretchable backing 36 coated with pressure sensitive adhesive and a face of hook members 37. The angular extent of the tread member 35 is less than 360°, the spacing between and the ends 38,39 being substantially equal to the axial width of tread members 35 and the Velcro tape 36,37. The tread members 35 are molded of impact resistant thermoplastic such as high impact styrene, polyethylene, polypropylene, nylon, cryolac, etc. and therefore provide essentially rigid surfaces to which the backing 36 "Velcro" tape adheres. Also the ends 38,39 provide definite starting points for the application of the tape by automatic machinery. If the tape is to be applied in a clockwise direction, the application would start with the end 39 and finish with the end 38. To construct a ball which is functionally identical with the ball of Application 570,509 two of the units shown in FIG. 15 are required. These units would be arranged in planes at right angles to each other with one of the units rotated 180° with respect to the other unit from the position shown in FIG. 15. The two units would then be moved together so that the ends 38,39 of each unit straddled the edges of the rim of the other unit and the axes of the rims intersect. By cementing or welding the ends 38,39 of one rim member 35 to the opposite edges of the other rim 35, a ball would be obtained which would be structurally similar and functionally identical to the ball shown in FIGS. 4,5,6 and 7. The sole difference would be in the manner of support for the rim members 35.

FIGS. 9—12 are shown several variations of the balls which incorporate the rim or tread members of FIG. 15 but which use a different structure for supporting the treads. All of these modifications are adapted to blow molding in a single piece but can also be made by molding in two pieces by injection molding or vacuum forming of impact resistant thermoplastic.

Figure 9:
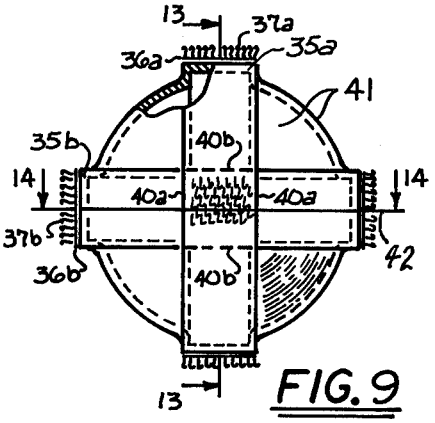
Figure 14:
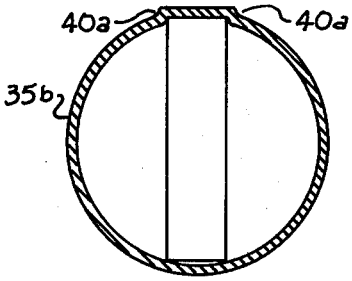
FIG. 14 is a section on line 14—14 of FIG. 9.

In FIG. 9 there are two rims 35*a*, 35*b* in planes at right angles to each other. The rim 35*a* has edges or shoulders 40*a* which project above a spherical surface 41 integral with the treads 35*a*, 35*b*. The shoulders 40*a* serve as starting points for the application of the tape 36*b*, 37*b* to the rim 35*b* (FIG. 14). The rim 35*b* has shoulders which project above the spherical surface 41 and serve as starting points for the application of the tape 36*a*, 37*a* to the rim 35*a*. The shoulders 40*b* are diametrically opposite the shoulders 40*a* and are therefore indentified by dotted lines. The rims 35*a*, 35*b* are in planes at right angles to each other with both planes perpendicular to the paper and with the axes of the rims intersecting. The spherical section 41 integrally connects the rims 35*a*, 35*b* and provides mechanical and structural support. The ball of FIG. 9 may be made in one piece by blow molding in which case the spherical section 41 and the rim section 35*a*, 35*b* may be of substantially the same wall thickness. The ball of FIG. 9 could also be made by injection molding or vacuum forming in two pieces on opposite sides of a parting line 42. These pieces would be cemented or welded together prior to the application of the tape.

Figure 10:
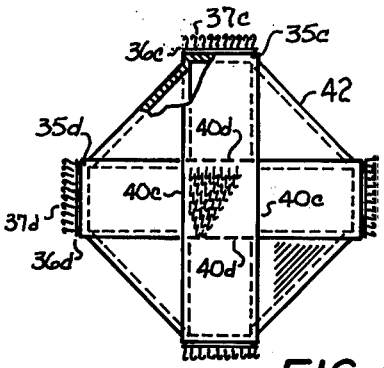

The ball of FIG. 10 has rims 35*c*, 35*d* corresponding respectively to rims 35*a*, 35*b*. The rim 35*c* has shoulders 40*c* which serve as starting points for the application of pressure sensitive Velcro tape 36*d*, 37*d*. The rim 35*d* has shoulders 40*d* which serve as starting points for the tape 36*c*, 37*c*. FIG. 10 differs from FIG. 9 in the substitution of planar walls 42 in place of spherical walls 41 of FIG. 9.

Figure 11:
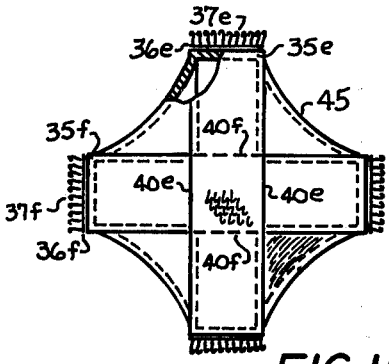

FIG. 11 has rims 35*e*, 35*f* corresponding to the rims 35*a*, 35*b*. The rim 35*e* has shoulders 40*e* indicating the starting points for the application of tape 36*f*, 37*f*. The rim 35*f* has similar shoulders 40*f* indicating the starting points for the application of tapes 36*e*, 37*e*. The shoulders 40*e* are diametrically opposite the shoulders 40*f* and are therefore indicated by dotted lines. FIG. 11 differs from FIG. 9 in the substituting of concave walls 45 for a spherical wall 41.

Figure 12:
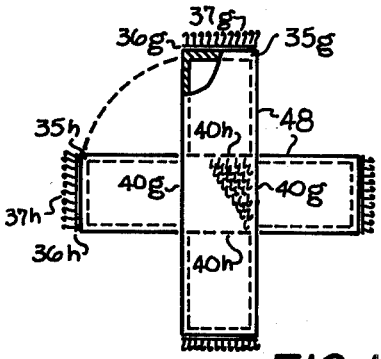
Figure 13:
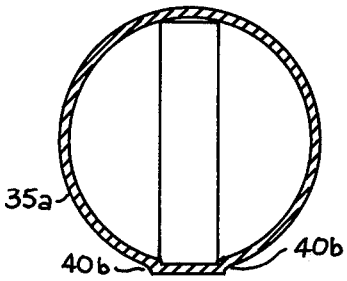
FIG. 13 is a section on line 13—13 of FIG. 9.

FIG. 12 has rims 35*g*, 35*h* corresponding to the rims 35*a*, 35*b*. The shoulders 40*g*, 40*h* respectively indicates the starting points for the tapes 36*h*, 37*h* and 36*g*, 37*g*. FIG. 12 differs from FIG. 9 in the substitution of reentrant angular walls 48 for the spherical walls 41.

Figure 16:
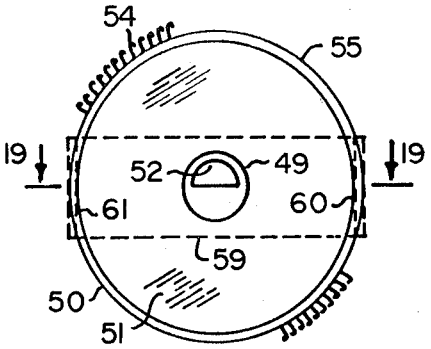
FIG. 16 is a plan view of an element of another ball.
Figure 17:
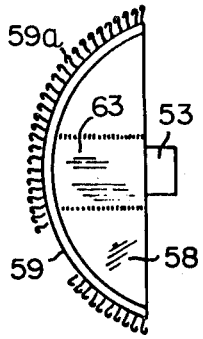
FIG. 17 is a plan view of another element of the FIG. 16 ball.
Figure 18:
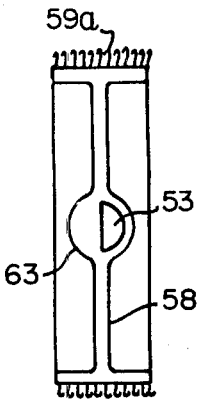
FIG. 18 is an end view of FIG. 17.
Figure 19:
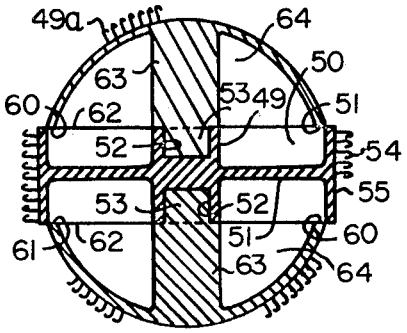
FIG. 19 is a section of line 19—19 of FIG. 16 with the FIG. 17 elements assembled thereto.

FIGS. 16–19 show another ball of impact resistant thermoplastic with flat cylindrical tread for receiving Velcro tape. The ball consists of three parts, a wheel (FIG. 16) and two segmental sections (FIGS. 17, 18) which are assembled to form a ball (FIGS. 16,19). When assembled, the ball is functionally equivalent to the balls of FIGS. 4–8 and 9–15.

The part shown in FIG. 16 is in the form of a wheel with a hub 49, a rim or freely 50 and a rim supporting means or structure such as disc 51 between the hub and the rim. In opposite ends of the hub 1 are non circular sockets 52 for receiving complimentary projections 53 on the other parts of the ball. On the outer surface of the rim is a tire 54 of burr material.

A convenient form of burr material for the tire 54 is pressure sensitive Velcro tape having a width equal to the width of the rim 50. The tape has a textile backing coated with a pressure sensitive adhesive and a face or pile of closely spaced stiff plastic spines terminating in hook ends. The tape can conveniently be applied by rolling the rim 50 over the length of tape equal to the outside circumference of the rim. As the rim is rolled over the adhesive side of the tape, the required pressure is applied to unite the tape and the rim. Alternately the tape could be wound around the rim.

The outer or hook surface of the tape makes gripping contact with many knit or tufted textiles and also with special gripping Velcro material having a face or pile consisting of closely spaced plastic loops. The targets shown in FIGS. 20 and 21 have a face of knit nylon and a back of urethane foam.

Figure 20:
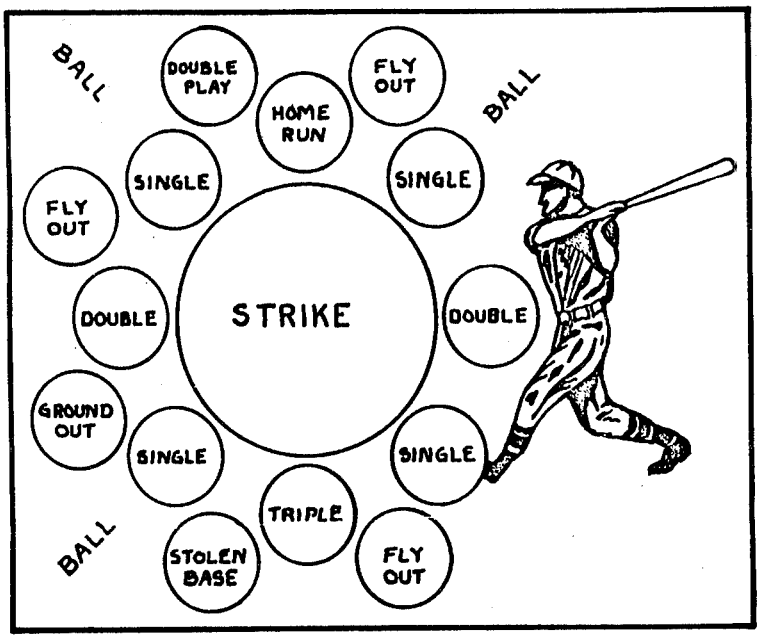

The target of FIG. 20 has printed legends adapting it to baseball scoring. The FIG. 21 target has legends for conventional scoring with the winner being the first to reach an arbitrary total of, for example, thirty-three.

Figure 21:
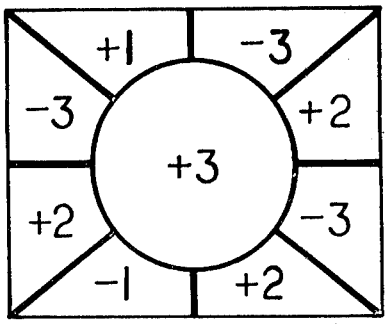
FIGS. 20 and 21 are views of targets for use with any burr coated ball.

The disc or wheel 49–51 could be used by itself as the projectile for either of the targets FIGS. 20, 21. It could be thrown as a flying scaucer and the part of the tire 54 first contacting the target would be immediately gripped to indicate the score. For this purpose, the hub 49 and socket 52 would not be necessary. The discs 51 and rim 50 could be redesigned to incorporate the aerodynamic effects of flying saucer type projectiles. The cylindrical rim 50 would be retained for ease of application of the burr material and also for improved gripping action. The flat tread of tire 54 maximizes the gripping contact particularly with a target of flexible material such as foam backed nylon knit.

In order to convert the disc or wheel element 49–51 to a ball type projectile, two of the elements 58 shown in FIGS. 17 and 18 are assembled to opposite ends of hub 49. These elements are aligned in planes at right angles to the plane of the rim 50 by the non circular projections 53 which seat in non circular recesses 52 in opposite ends of the hub 49. The elements 58 have rim segments 59 of substantially the same curvature as the rim 50 with ends 60, 61 which when assembled in FIG. 19 abut opposite edges 62 of the rim 50. The elements 58 also have circular bosses 63 which when assembled are in essentially direct continuation with the hub 49. The rim segments 59 are reinforced by a segmental disc section 64. The parts 58 are adapted to injection molded thermoplastic in the same manner as the wheel element. A mold having three cavities could mold all of the parts for a ball in the same molding cycle. The rim segments 59 may be coated with tires **59*a* of burr material in the same manner as the rim 50.** These operations are easily automated. The use of pressure sensitive adhesive is convenient but is not necessary. Other adhesive or fastening means may be used.

The outer or tread surface of the rim 50 and of segmental rim 59 is such that the burr material will easily conform to the backing of the material as it is applied. The backing of the Velcro burr material is easily bendable but is relatively non stretchable. A flat cylindrical surface 55 as illustrated is ideal. A slight crowning as in pulleys can be tolerated. The curvature of the surface as viewed in FIG. 19 should not exceed the ability of the burr material to conform to the surface. The cylindrical outer surface of rim 50 and rim segments 59 should be substantially flat in an axial direction in the same that the intersection with any plane through the axes of the rim 50 or rim segments 59 is a substantially straight line.

The radius of curvature of the rim 50 and of the segmental rims 59 are the same. Because the ends of the segmental rims contact the rim 2 in planes spaced on opposite sides of the axis of the hub 1 as shown in FIG. 16, it would appear from the section of FIG. 19 that the ball would encounter an objectionable bump when rolled on tires **59*a*.** This does not happen and in any event is immaterial because the ball never rolls. As soon as the ball contacts the target, it sticks and does not roll.

When either tire 52 or **59*a* contacts the target squarely the adhesion to the target is as illustrated in the upper part of FIG. 8. When the tires contact the target with the tires in planes at an angle of 45° to the target as shown in the lower part of FIG. 8,** the edge adhesion is ample and would be ample if only a single tire edge made contact with the target. The result is that the ball structure can be thrown or launched like a ball and will stick to the target at the point of contact.

The cost of a ball structure of this application are much less than the cost of truly spherical balls with burr material applied to the outer surface. First, the burr material can only be applied to a spherical surface in spots or in narrow strips where the weakest adhesion is at the edges, the points at which the adhesion should be strongest. The burr material therefore tends to peel off the ball, a process which accelerates once started. Also peeling interferes with the aerodynamic destroying the fairness of the game. Second, the application of spots of narrow strips must be by hand. The result is that the cost of application is on the order of four times the cost of complete ball structure of this application.

Figure 6:
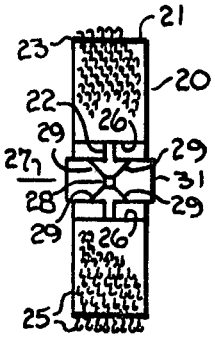
Figure 7:
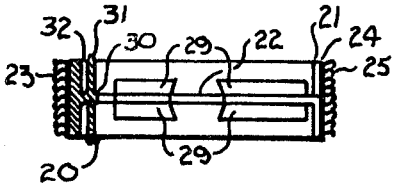

The part shown in FIGS. 5–7 may be used as a disc or flying saucer, as a sling shot propelled dart, as the tip of an arrow or dart.

What is claimed is:

1. A ball adapted to stick to a target of burr adherent material, said ball consisting of two intersecting rims of impact resistant plastic in planes at right angles to each other, means for fixing said rims in the aforesaid relation, each of said rims having a substantially flat rigid outer surface and tapes having a substantially non stretchable backing and a face of synthetic burr material with the backing adhered to said flat surfaces and with the face outermost whereby a ball contacting a target of burr adherent material is held against said target,

2. The ball of claim 1 in which the means for fixing said rims is further defined as walls bridging the spaces between rims.

3. The ball of claim 2 in which the walls are convex.

4. The ball of claim 2 in which the walls form a reentrant angle.

5. The ball of claim 2 in which the walls are concave.

6. The ball of claim 1 in which the fixing means and rims are in a single piece.

7. The ball of claim 1 in which each rim has a slot straddling the other rim.

8. The ball of claim 7 in which the rims are identical.

9. The ball of claim 8 in which the slot in one rim is diametrically opposite the slot in the other rim.

10. The ball of claim 1 in which one of the rims has shoulders facing the ends of the tape of the other rim.

11. The ball of claim 1 in which both rims have shoulders facing the ends of the tape of the other rim and the shoulders on one rim are diametrically opposite the shoulders on the other rim.

12. The ball of claim 1 in which the ball has two intersecting rim supporting elements at right angles to each other and each rim supporting element is integral with one of the rims.

13. The ball of claim 12 in which each rim supporting element is further defined as having a recess extending inward from its periphery, the recess in one rim supporting element extending in a direction opposite the direction in which the other rim supporting element extends.

14. The ball of claim 13 in which the reccesses have interengaging guide surfaces aligning the rim supporting elements in planes at right angles to each other.

15. The ball of claim 13 the recesses having interengaging detent elements for holding the rim supporting elements together.

16. The ball of claim 12, in which one of the rim supporting elements has a one piece rim and the other rim supporting element has a rim in two segmental pieces.

17. The ball of claim 12 in which one of the rim supporting elements has a hub integral with its rim and the other rim supporting element has a rim of two concentric segmental members with ends respectively abutting opposite sides of the first rim.

18. The ball of claim 17 in which the segmental elements have bosses in line with said hub and there are interfitting elements on the hub and bosses for fixing the rims together.

* * * * *